US006548136B1

(12) United States Patent
Piccini et al.

(10) Patent No.: US 6,548,136 B1
(45) Date of Patent: Apr. 15, 2003

(54) PERFORATED SHEET OF MATERIAL

(75) Inventors: Andrea Piccini, Rome (IT); Maurizio Pucci, Rome (IT); Giuseppe Sirianni, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/890,093

(22) PCT Filed: Jan. 20, 2000

(86) PCT No.: PCT/US00/01388

§ 371 (c)(1),
(2), (4) Date: Sep. 24, 2001

(87) PCT Pub. No.: WO00/44270

PCT Pub. Date: Aug. 3, 2000

(30) Foreign Application Priority Data

Jan. 29, 1999 (EP) ..... 99101890

(51) Int. Cl.[7] ..... B32B 3/10

(52) U.S. Cl. ..... 428/43; 428/136

(58) Field of Search ..... 428/43, 136

(56) References Cited

U.S. PATENT DOCUMENTS 5,562,964 A * 10/1996 Jones ..... 428/43

* cited by examiner

*Primary Examiner*—Alexander S. Thomas
(74) *Attorney, Agent, or Firm*—Jason J. Camp; Thibault Fayette; Kim William Zerby

(57) ABSTRACT

The present invention relates to sheets of material (1), preferably wet wipes for use in wiping surfaces in the home and in industry, in addition to their use on the human body such as for baby wipes, make-up removal and other skin care applications. The wet wipes are provided with an improved perforation configuration (20) to improve visibility of the location of the perforation and ease of dispensing and separation of the wipes, whilst providing sufficient strength to prevent tearing during use.

10 Claims, 2 Drawing Sheets

PERFORATED SHEET OF MATERIAL

FIELD OF THE INVENTION

The present invention relates to sheets of material preferably wet wipes which are provided with an improved perforation configuration, which is easily visible to the consumer and which allows the wet wipes to be easily separated from oneanother whilst not compromising on strength.

BACKGROUND OF THE INVENTION

Wet wipes are typically premoistened, disposable towelettes which may be utilised in a variety of applications both domestic and industrial and perform a variety of functions. Wet wipes are typically used to wipe surfaces both animate and inanimate, and may provide numerous benefits such as cleaning, cleansing, disinfecting, and skin care benefits.

One particular application is the use of wet wipes for wiping parts of the human body particularly when wash water is not available, for example when travelling. Wipes are commonly used for human cleansing and wiping such as face and hand cleansing and anal, perineal and genital cleansing for example as intimate hygiene wipes such as feminine wet wipes. Wet wipes may also be used for application of substances to the body including removing and applying of make-up, skin conditioners and medications. Another application of wipes is during diaper changes and also for the treatment of adult and baby dermatitis partly caused by the use of diapers and incontinence devices. In addition wet wipes are also applicable for wiping and or cleaning other surfaces or for the application of compositions to surfaces, for example kitchen and bathroom surfaces, eyeglasses, shoes and surfaces which require cleaning in industry for example surfaces of machinery or automobiles. Wet wipes also include articles used for the cleaning or grooming of pets.

Wet wipes are commonly constructed from combinations of synthetic and natural fibres, such as polyolefin fibres, viscose fibres and cotton fibres, which are generally moistened with an aqueous composition which contains amongst others surfactants, preservatives, oils and scents. The wet wipes are then typically provided in a folded stacked configuration within a covered container such as a tub-like container having a lid. Alternatively, the wipes may be provided in tub containers having a dispensing aperture. In both cases this allows easy transportation and storage of the wipes. Typically the wipes are packaged in a plastic foil in order to protect the wet wipes prior to use.

In order to aid dispensing and to allow the consumer to select the desired size of wipe it is highly desirable to provide the wipes with perforations. The use of perforations is well known in the field of paper, tissue and towels. For example, U.S. Pat. No. 5,704,566 discloses a roll of paper towelling to be dispensed from a dispenser which may be separated into towelling segments by pulling along perforated tear lines. The perforated tear lines comprise a plurality of slits which are longer towards the side edges of the paper than in the middle, to aid dispensing.

Similarly DE 27 06 234 discloses the use of perforated lines of variegated holes formed in a paper sheet, the diameter of which increases towards the edge of the paper so as to facilitate tearing of the paper by one hand.

The use of perforations for wet wipes is particularly advantageous not only in terms of dispensing, but also in allowing the consumer to select the length or amount of wet wipe material required to carry out a particular clearing activity. Thus for small and easy cleaning activities just one wipe can be selected, whilst for larger and dirty cleaning activities a number of wipes can be used. Thus it is not only important that the consumer can easily dispense the size of wipe that is required, it is also equally important that the perforations are strong enough such that they do not break or tear within a larger wipe during the cleaning process. This problem of perforation strength is further exacerbated upon storage of the wet wipes which has been found to generally weaken the perforation.

In addition another important factor with respect to the convenient usage of such wipes, is that the consumer can readily identify the location of the perforations in the wipe substrate. The visibility of the perforations is related to the length of the perforation or slit in the substrate; larger perforations or slits providing easy recognition by the consumer. However a problem with such larger perforations is that the strength of the perforations is further reduced, which is as discussed above highly undesirable. This problem is yet further exacerbated by certain dispensing methods. For example methods which result in continuous dispensing through a container orifice whereby mechanical friction is utilised to dispense and separate the wipes.

It is therefore desirable to provide a wet wipe stacking configuration which is suitable for multiple applications such as baby wipes and hard surface cleaning wipes which are strong, soft, absorbent and provide improved cleaning. It is further desirable to provide wet wipes whereby the wipe substrate is provide with perforated tear lines that are readily visible so that the consumer can select the desired length of wipe required and easily separate the wipes from oneanother, whilst providing sufficient strength so that the perforation within the wipe does not tear or break during use.

SUMMARY OF THE INVENTION

The present invention hence relates to a sheet of material, preferably a wet wipe for wiping parts of the human body such as baby wipes and other inanimate surfaces. In particular, the present invention relates to a sheet of material (1) such as a wet wipe, wherein said sheet of material comprises at least one transverse perforation line (20), said transverse perforation line (20), having at least one repeating perforation pattern (21), characterised in that each of said repeating patterns (21) has at least one primary perforation slit (22), at least one secondary perforation slit (23) and at least two bonded areas (24), wherein the length ratio of one of said primary perforation slits (22) to one of said secondary perforation slits (23) is from 100:1 to 1.5:1 and wherein the ratio of the total length of said bonded areas (24), to the total length of said primary (22) and secondary (23) perforation slits of said perforation line is from 1:1 to 1:6.

DETAILED DESCRIPTION OFT HE INVENTION

Figure 1A:
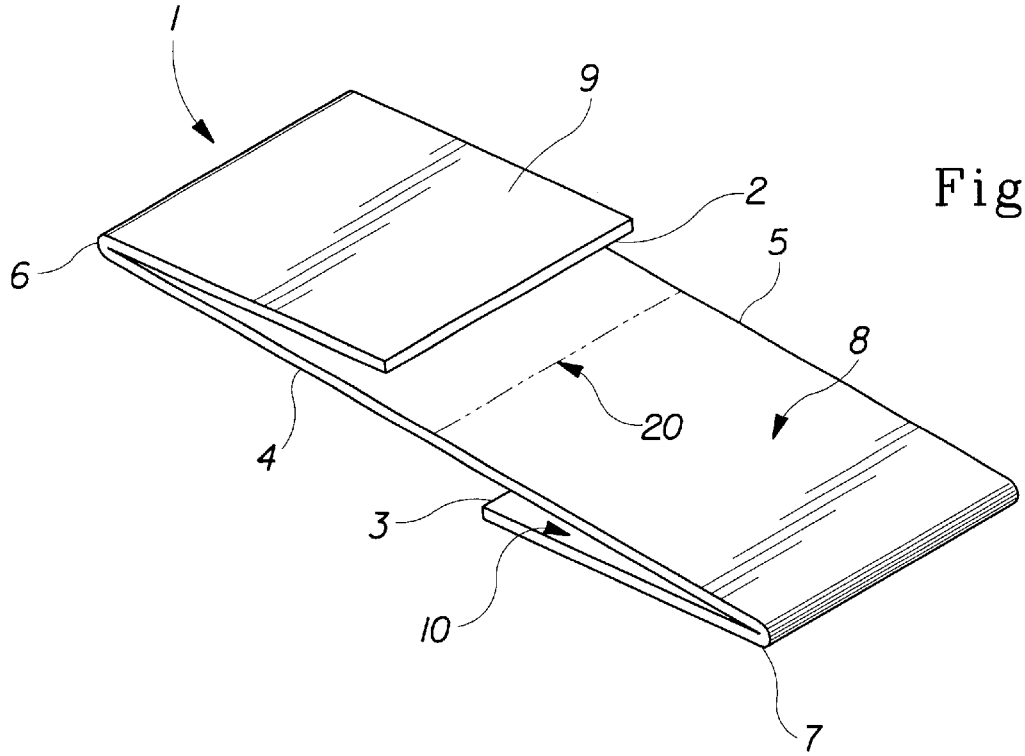
FIG. 1*a*: Is a plan view of a sheet material, e.g. a wet wipe showing the perforation line of the present invention.
Figure 1B:
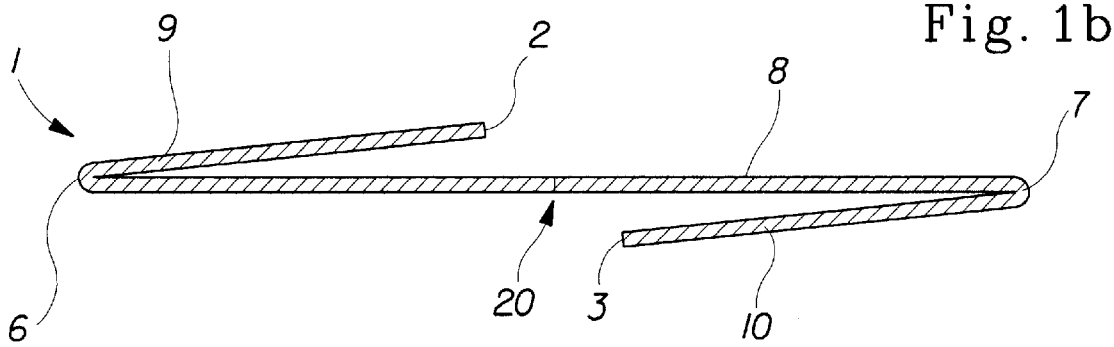
FIG. 1*b*: Is a cross sectional side view of the sheet material of FIG. 1, comprising perforation line according to the present invention.
Figure 2:
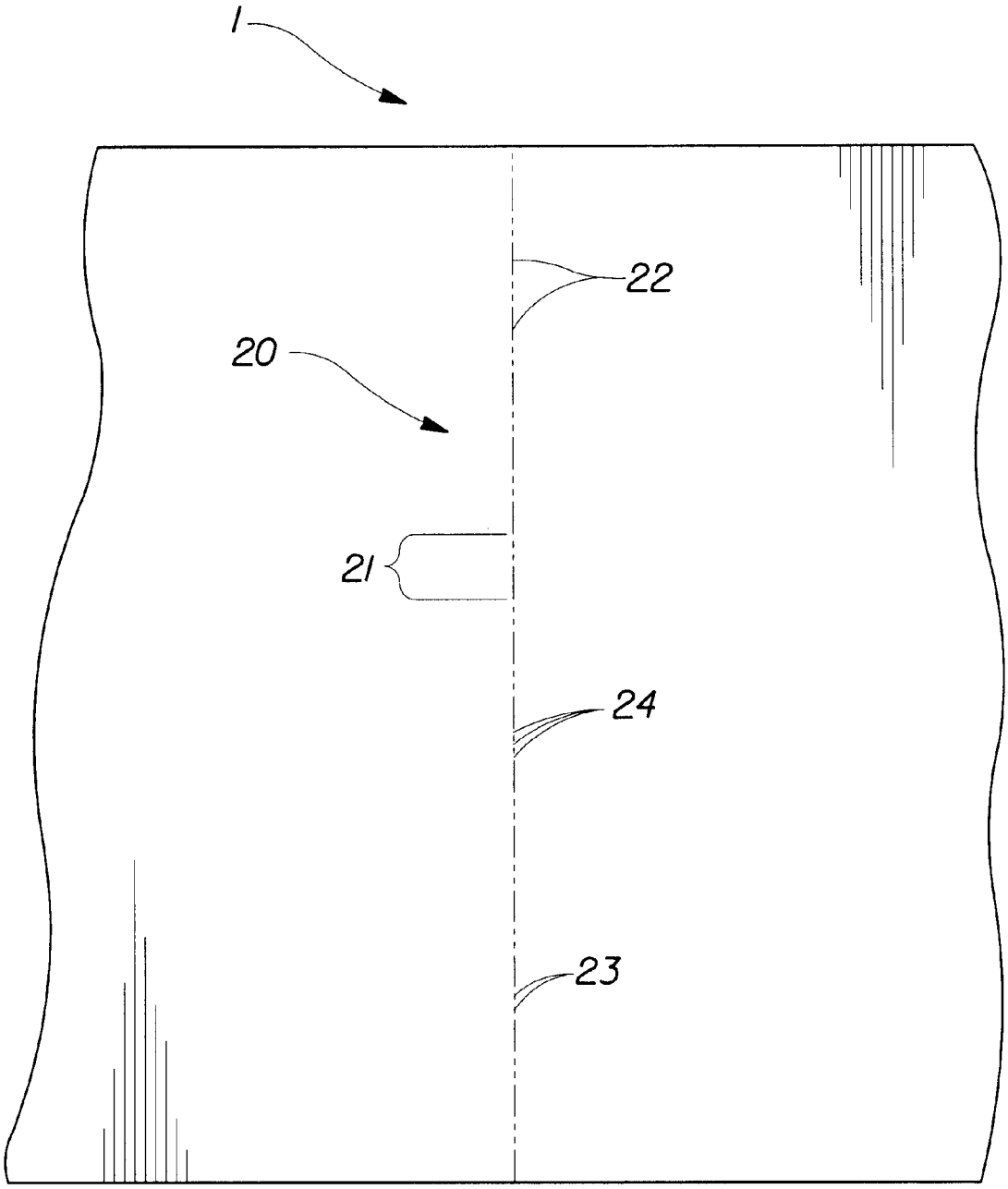
FIG. 2: Is a partial plan view of a sheet of material having the preferred perforation line of the present invention.

According to the present invention the sheet of material comprises a substrate which is preferably coated or impregnated with a liquid composition. The sheet of material may be woven or nonwoven, foam, sponge, battings, balls, puffs, films, or tissue paper, most preferably a nonwoven and may be composed or natural or synthetic fibres or mixtures thereof. Preferably, the fibre compositions are a mixed of hydrophilic fibre material such as viscose, cotton, or flax and a hydrophobic fibre material such as polyethylene tetraphthalate (PET) or polypropylene (PP) in a ratio of 10%–90% hydrophilic and 90%–10% hydrophobic material by weight. Particularly preferred compositions are 50% viscose, 50%PP; and 50% viscose, 50% PET; and 70% cellulose, 15% PET and 15% latex. The sheet of material preferably has a basis weight of at least 20 $gm^{-2}$ and preferably less than 150 $gm^{-2}$, and most preferably the base weight is in the range of 20 $gm^{-2}$ to 100 $gm^{-2}$, more preferably from 50 $gm^{-2}$ to 95 $gm^{-2}$. The sheet of material may have any caliper. Typically, when the sheet of material is made by an air laying process, the average sheet of material caliper is less than 1.0 mm. More preferably the average caliper of the sheet of material is from 0.1 mm to 0.9 mm. The sheet of material caliper is measured according to standard EDANA non woven industry methodology, reference method #30.4–89.

In addition to the fibers used to make the sheet of material, the sheet of material can have other components or materials added thereto as known in the art. The types of additives desirable will be dependent upon the particular end use of the substrate contemplated. For example, in wet wipe products such as moist toilet paper, paper towels, facial tissues, baby wipes and other similar air laid products, high wet strength is a desirable attribute. Thus, it is often desirable particularly for cellulose based materials to add chemical substances known in the art as wet strength resins. A general dissertation on the types of wet strength resins utilised in the paper art can be found in TAPPI monograph series No. 29, Wet Strength in Paper and Paperboard, Technical Association of the Pulp and Paper Industry (New York, 1965). Particularly preferred resins are polyamide-epichlorohydrin, polyacrylamides, styrene-butiene latexes, dialdehyde starch and mixtures thereof. In addition to wet strength additives, it can also be desirable to include certain dry strength and lint control additives known in the art such as starch binders. Furthermore, the material may also comprise agents to improve the optical characteristics of the material such as opacifying agents, for example titanium dioxide.

According to the present invention the sheet may be produced by any methods known in the art. For example nonwoven material substrates can be formed by dry forming techniques such as air-laying or wet laying such as on a paper making machine. Other nonwoven manufacturing techniques such as melt blown, spun bonded, needle punched and spun laced methods may also be used. A preferred method is air laying.

According to the present invention, the sheets of material are provided in a stacked configuration which may comprise any number of sheets. Typically, the stack comprises from 3 to 150, more preferably from 5 to 100, most preferably from 10 to 60 of sheets of material. Moreover the sheets may be provide in any configuration folded or unfolded. Most preferably the wipes are stacked in a folded configuration. In an alternative embodiment the sheet of material may be provided as a roll, which comprises a continuous material providing individual sheets connected end to end by perforation lines according to the present invention. The present invention will now be described with reference to the preferred embodiment of the present invention namely wet wipes. However the description is equally applicable to the alternative sheet materials and configurations.

Each folded wipe 1 extends lengthwise in the machine direction from a first, leading end edge 2, to a second, trailing end edge 3. The folded webs also have side edges 4 and 5 which extend lengthwise from the first leading end edge 2 to the second trailing end edge 3. Each folded wipe 1 can include a first panel fold 6 which is generally parallel to the leading edge 2, and which is generally perpendicular to the side edges 4, 5. The first panel fold 6 is spaced lengthwise from the leading edge 2 to provide a leading edge panel 9 extending between the first panel fold 6 and the leading edge 2. As used herein a panel is a portion of the wipe extending between two folds, or between a fold and an edge end.

The folded wipe can also include a second panel fold 7, and a first central panel 8, and a trailing edge panel 10. The second panel fold 7 is generally parallel to, and spaced lengthwise from, the first panel fold 6. The first central panel 8 is joined to the leading edge panel 9, at the first panel fold 6, and extends between the first panel fold 6 and the second panel fold 7.

The trailing edge panel 10 is joined to the first central panel 8 at the second panel fold 7. The trailing edge panel 10 extends between the second panel fold 7 and the trailing end edge 3. The wipe is folded at the first and second panel folds 6 and 7 to provide the leading edge panel 9, first central panel 8, and trailing edge panel 10, in a Z-fold configuration, as best,seen in FIG. 3*a*. In the Z-fold configuration, panel 9 is adjacent to and overlies a portion of panel 8, and panel is adjacent to and underlies a portion of panel 8. However, other folding configurations such as C folds or J folds configurations having more or less panels are equally applicable.

Furthermore in addition to the panels described herein above, the wipe may have additional panels. In particular, the leading edge panel and or the trailing edge panel may also be provided with an additional fold so as to provide a leading edge panel lip or a trailing edge panel lip. Such a lip is formed by providing the leading edge panel or the trailing edge panel with a panel lip fold which is adjacent to and spaced from the leading or trailing edge of the folded substrate to provide a lip extending between the panel lip fold and the end edge. The panel lip fold may be folded onto the lower surface of the leading edge panel such that the leading end edge is below the leading edge end panel. This configuration is particularly beneficial in facilitating grasping of the edge. Alternatively, the leading edge panel may be folded such that the leading end edge rests on the upper surface of the leading edge panel. The lip may also be positioned on the upper or lower surface of the trailing edge panel.

According to the present invention, the overall dimensions of the substrate material is dependent on the intended application of the wipe and can be selected accordingly. In one non limiting, illustrative example wherein the wipe may be utilised as a hard surface cleaning wipe, each folded wipe 1 can have an unfolded length of from 10 cm to 40 cm as measured lengthwise from the leading end edge 2 to the trailing end edge 3 and a width of from 10 cm to 25 cm. For each folded wipe 1, the lengths of the leading edge panel 9 and trailing edge panel 10 can be from 2 cm to 7 cm. In a preferred embodiment the spacing between the first panel fold 6 and the leading end edge 2 and the second panel fold 7 and the trailing edge 3, is preferably from 3 cm to 6. The spacing between the first panel fold 6 and the third panel fold 12 and the second panel fold 7 and the third panel fold 12 are preferably from 3 cm to 12 cm, and more preferably between about 8 cm and 12 cm.

According to the present invention the wet wipes are provided, with at least one transverse perforation lines (20). The perforation lines comprise perforated slits or cuts joined by wet substrate material in-between each perforated slit, herein after referred to as bonded area. The transverse perforation lines are provided typically at regular intervals. For the unlimiting example described hereinabove this will be from 9 cm to 20 cm, preferably from 12 cm to 16 cm.

It has now been found that the provision of the perforation line (20) with at least one repeating pattern (21) as defined herein provides the wet wipe stack with easily visible perforations which are strong.

Accordingly, the perforation lines (20) comprise at least one repeat pattern (21). According to the preferred embodiment of the present invention the perforation line (20) comprises at least one repeating pattern (21). However the perforation line (20) may comprise any number of repeating patterns. Each of said repeating pattern (21) comprises at least one primary perforation slit (22) and at least one, preferably from 1 to 20, more preferably from 2 to 10, secondary perforation slits (23). The exact number utilised can be readily selected by the skilled person depending on the material substrate type and use intended provided that certain parameters are meet. The length ratio between the primary (22) and the secondary (23) perforations slits from 100:1 to 1.5:1, preferably from 50:1 to 2:1, more preferably from 25:1 to 2:1, most preferably from 10:1 to 3:1. The presence of a primary slit (22) which is substantially longer than the secondary slit (23) provides an easily recognisable means for the consumer to locate the perforation line along the wipe. The perforation slits whether primary (22) or secondary (23) are separated from one another by the wet wipe substrate material. This substrate material is referred to as bonded area (24). Typically the ratio of the length of one of the bonded areas (24) to the length of one of the secondary perforation slits (23) is from 10:1 to 1:10 preferably from 5:1 to 1:5, most preferably 1:2 to 1:1. The exact number utilised can be readily selected by the skilled person depending on the material substrate type and use intended provided that certain parameters are meet. Typically each perforation line (20) comprises at least one repeating pattern (21), which is repeated at least once, preferably from 1 to 50, more preferably from 5 to 25, most preferably from 10 to 20 times, depending upon the length of the repeating pattern and the width of the wipe.

It has been identified that in order to ensure the desired tensile strength of the wet wipes, the ratio of the total length of the bonded area (24) to the total length of the primary (22) and secondary (23) perforation slit along the perforation line (20) is from 1:1 to 1:6,preferably from 1:1.5 to 1:4, more preferably from 1:2 to 1:3.5.

Typically the ratio of the width of the wipe to the length of the total bonded area (24) along the perforation line (20) is from 10:1 to 1:10, preferably from 5:1 to 3:1.

For the wet wipe of the unlimited example described herein above the length of each primary perforation slit (22) is from 3 mm to 10 mm, preferably from 3 mm to 8 mm, more preferably from 3.5 mm to 6.5 mm. The length of each secondary perforation slit (23) is from 0.5 mm to 2.5 mm, preferably from 1 mm to 2 mm. The length of each bonded area (24) is from 0.5 mm to 10 mm, preferably from 0.5 mm to 3 mm, more preferably from 0.5 mm to 1.5 mm.

In order to provide the desired tensile strength, the perforation lines should preferably exhibit a tensile strength of at least 0.7 N/inch (0.28 N/cm) to 5 N/inch (1.97 N/cm), more preferably from 1 N/inch (0.39 N/cm) to 4.5 N/inch (1.77 N/cm), most preferably from 1.8 N/inch (0.70 N/cm) to 4.0 N/inch (1.57 N/cm) as described in the EDANA 30 test method camed out on the material within 24 hours of manufacture.

According to the present invention, the substrate material of the wipes is typically impregnated or coated with a liquid composition. The composition may be aqueous, alcohol based or an emulsion, either a water-in-oil or a oil-in-water or a multiple emulsion, preferably the emulsion is a oil-in-water emulsion.

Typically, the composition will comprise from 2% to 50% by weight of said composition of actives and from 50% to 98% water, preferably de-ionised or distilled. Of the active component, preferably 2% to 20% are present in the oil phase and the remainder are present in the aqueous phase.

The liquid composition can provide a number of different benefits when released. For example, in wet-like cleaning wipes for perianal cleaning the water component is released and thereby provides the primary cleansing action for these wipes.

In a preferred embodiment of the present invention the liquid composition (preferably comprising water as a major constituent) comprises a disinfecting component comprising an antimicrobial compound, preferably an essential oil or an active thereof, and a bleach, preferably a peroxygen bleach. Disinfecting wipes comprising such a liquid composition provide effective disinfecting performance on a surface while being safe to the surface treated.

By "effective disinfecting performance" it is meant herein that the disinfecting wipes of the present invention allow significant reduction in the amount of bacteria on an infected surface. Indeed, effective disinfecting may be obtained on various micro-organisms including Gram positive bacteria like Staphylococcus aureus, and Gram negative bacteria like Pseudomonas aeruginosa, as well as on more resistant micro-organisms like fungi (e.g., Candida albicans) present on infected surfaces.

Another advantage of the disinfecting wipes according to the present invention is that besides the disinfecting properties delivered, good cleaning is also provided as the disinfecting polar phase may further comprise surfactants and/or solvents.

An essential element of such disinfecting liquid compositions is an antimicrobial compound typically selected from the group consisting of an essential oil and an active thereof, paraben (e.g., methyl paraben, ethyl paraben), glutaraldehyde and mixtures thereof. Essential oils or actives thereof are the preferred antimicrobial compounds to be used herein.

Suitable essential oils or actives thereof to be used herein are those essential oils which exhibit antimicrobial activity and more particularly antibacterial activity. By "actives of essential oils" it is meant herein any ingredient of essential oils that exhibits antimicrobial/antibacterial activity. A further advantage of said essential oils and actives hereof is that they impart pleasant odour to the disinfecting wipes according to the present invention without the need of adding a perfume. Indeed, the disinfecting wipes according to the present invention deliver not only excellent disinfecting performance on infected surfaces but also good scent.

Such essential oils include, but are not limited to, those obtained from thyme, lemongrass, citrus, lemons, oranges, anise, clove, aniseed, cinnamon, geranium, roses, mint, lavender, citronella, eucalyptus, peppermint, camphor, sandalwood and cedar and mixtures thereof. Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, terpineol, limonene, methyl salycilate and mixtures thereof. Preferred actives of essential oils to be used herein are thymol, eugenol, verbenone, eucalyptol, carvacrol, limonene and/or geraniol. Thymol may be commercially available for example from Aldrich, eugenol may be commercially available for example from Sigma, Systems—Bioindustries (SBI)—Manheimer Inc.

Typically, the antimicrobial compound or mixtures thereof will be present in the liquid composition at a level of from 0.001% to 5%, preferably from 0.001% to 3%, more preferably from 0.005% to 1%, by weight of liquid composition.

An important element of the internal disinfecting polar phase is a bleach or mixtures thereof. Any bleach known to those skilled in the art may be suitable to be used herein including any chlorine bleach as well as any peroxygen bleach. The presence of the bleach, preferably the peroxygen bleach, in the disinfecting wipes of the present invention contribute to the disinfecting properties of the wipes.

Suitable chlorine bleaches to be used herein include any compound capable of releasing chlorine when said compound is in contact with water. Suitable chlorine bleaches include alkali metal dichloroisocyanurates as well as alkali metal hypohalites like hypochlorite and/or hypobromite. Preferred chlorine bleaches are alkali metal hypochlorites. Various forms of alkali metal hypochlorite are commercially available, for instance sodium hypochlorite.

Preferred bleaches for use herein are peroxygen bleaches, more particularly hydrogen peroxide, or a water soluble source thereof, or mixtures thereof. Hydrogen peroxide is particularly preferred.

Peroxygen bleaches like hydrogen peroxide are preferred herein as they are generally well accepted from an environmental point of view. For example the decomposition products of hydrogen peroxide are oxygen and water.

As used herein, a hydrogen peroxide source refers to any compound which produces perhydroxyl ions when said compound is in contact with water. Suitable water-soluble sources of hydrogen peroxide for use herein include percarbonates, persilicates, persulphates such as monopersulfate, perborates, peroxyacids such as diperoxydodecandioic acid (DPDA), magnesium perphthalic acid, dialkylperoxides, diacylperoxides, performed percarboxylic acids, organic and inorganic peroxides and/or hydroperoxides and mixtures thereof.

Typically, the bleach or mixtures thereof is present at a level of from 0.001% to 15% by weight of the liquid composition, preferably from 0.001% to 5%, and more preferably from 0.005% to 2%.

The liquid composition may further comprise a detersive surfactant or a mixture thereof. Typically, the surfactant or mixtures thereof is present at a level of from 0.001% to 40% by weight of the total internal polar phase, preferably from 0.01% to 10% and more preferably from 0.05% to 2%.

Suitable detersive surfactants to be used in the present invention include any surfactant known to those skilled in the art like nonionic, anionic, cationic, amphoteric and/or zwitterionic surfactants. Preferred detersive surfactants to be used herein are the amphoteric and/or zwitterionic surfactants.

Suitable amphoteric detersive surfactants to be used herein include amine oxides of the formula $R^1R^2R^3NO$, wherein each of $R^1$, $R^2$ and $R^3$ is independently a saturated, substituted or unsubstituted, linear or branched hydrocarbon chain having from 1 to 30 carbon atoms. Preferred amine oxide surfactants to be used according to the present invention are amine oxides of the formula $R^1R^2R^3NO$, wherein $R^1$ is an hydrocarbon chain having from 1 to 30 carbon atoms, preferably from 6 to 20, more preferably from 8 to 16, most preferably from 8 to 12, and wherein $R^2$ and $R^3$ are independently substituted or unsubstituted, linear or branched hydrocarbon chains having from 1 to 4 carbon atoms, preferably from 1 to 3 carbon atoms, and more preferably are methyl groups. $R^1$ may be a saturated, substituted or unsubstituted, linear or branched hydrocarbon chain. Suitable amine oxides for use herein are for instance natural blend $C_8$–$C_{10}$ amine oxides as well as $C_{12}$–$C_{16}$ amine oxides commercially available from Hoechst. Amine oxides are preferred herein as they deliver effective cleaning performance and further participate to the disinfecting properties of the disinfecting wipes herein.

Suitable zwitterionic surfactants to be used herein contain both cationic and anionic hydrophilic groups on the same molecule at a relatively wide range of pH's. The typical cationic group is a quaternary ammonium group, although other positively charged groups like phosphonium, imidazolinium and sulfonium groups can be used. The typical anionic hydrophilic groups are carboxylates and sulfonates, although other groups such as sulfates, phosphonates, and the like can be used. A generic formula for some zwifterionic surfactants to be used herein is $$R^1-N^+(R^2)(R^3)R^4X^-$$

wherein $R^1$ is a hydrophobic group; $R^2$ and $R^3$ are each $C_1$–$C_4$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from 1 to 10 carbon atoms; and X is the hydrophilic group which is preferably a carboxylate or sulfonate group. Preferred hydrophobic groups $R^1$ are alkyl groups containing from 1 to 24, preferably less than 18, more preferably less than 16 carbon atoms. The hydrophobic group can contain unsaturation and/or substituents and/or linking groups such as aryl groups, amido groups, ester groups and the like. In general, the simple alkyl groups are preferred for cost and stability reasons.

Highly preferred zwitterionic surfactants include betaine and sulphobetaine surfactants, derivatives thereof or mixtures thereof. Said betaine or sulphobetaine surfactants are preferred herein as they help disinfecting by increasing the permeability of the bacterial cell wall, thus allowing other active ingredients to enter the cell.

Furthermore, due to the mild action profile of said betaine or sulphobetaine surfactants, they are particularly suitable for the cleaning of delicate surfaces, e.g., hard surfaces in contact with food and/or babies. Betaine and sulphobetaine surfactants are also extremely mild to the skin and/or surfaces to be treated.

Suitable betaine and sulphobetaine surfactants to be used herein are the betaine/sulphobetaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred betaine and sulphobetaine surfactants herein are according to the formula

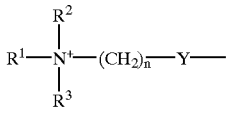

wherein $R^1$ is a hydrocarbon chain containing from 1 to 24 carbon atoms, preferably from 8 to 18, more preferably from 12 to 14, wherein $R^2$ and $R^3$ are hydrocarbon chains containing from 1 to 3 carbon atoms, preferably 1 carbon atom, wherein n is an integer from 1 to 10, preferably from 1 to 6, more preferably is 1, Y is selected from the group consisting of carboxyl and sulfonyl radicals and wherein the sum of $R^1$, $R^2$ and $R^3$ hydrocarbon chains is from 14 to 24 carbon atoms, or mixtures thereof.

Examples of particularly suitable betaine surfactants include $C_{12}$–$C_{18}$ alkyl dimethyl betaine such as coconutbetaine and $C_{10}$–$C_{16}$ alkyl dimethyl betaine such as laurylbetaine. Coconutbetaine is commercially available from Seppic under the trade name of Amonyl 265". Laurylbetaine is commercially available from Albright & Wilson under the trade name Empigen BB/L".

Other specific zwitterionic surfactants have the generic formulas:

$$R^1—C(O)—N(R^2)—(C(R^3)_2)_n—N(R^2)_2^{(+)}\text{-}(C(R^3)_2)_n—SO_3^{(-)}; \text{ or}$$

$$R^1—C(O)—N(R^2)—(C(R^3)_2)_n—N(R^2)_2^{(+)}\text{-}(C(R^3)_2)_n—COO^{(-)}$$

wherein each $R^1$ is a hydrocarbon, e.g. an alkyl group containing from 8 up to 20, preferably up to 18, more preferably up to 16 carbon atoms, each $R^2$ is either hydrogen (when attached to the amido nitrogen), short chain alkyl or substituted alkyl containing from 1 to 4 carbon atoms, preferably groups selected from the group consisting of methyl, ethyl, propyl, hydroxy substituted ethyl or propyl and mixtures thereof, preferably methyl, each $R^3$ is selected from the group consisting of hydrogen and hydroxy groups and each n is a number from 1 to 4, preferably from 2 to 3, more preferably 3, with no more than one hydroxy group in any $(C(R^3)_2)$ moiety. The $R^1$ groups can be branched and/or unsaturated. The $R^2$ groups can also be connected to form ring structures. A surfactant of this type is a $C_{10}$–$C_{14}$ fatty acylamidopropylene-(hydroxypropylene)sulfobetaine that is available from the Sherex Company under the trade name "Varion CAS sulfobetaine".

Suitable nonionic surfactants to be used herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Surfactant catalogues are available which list a number of surfactants, including nonionics, together with their respective HLB values.

Particularly suitable for use herein as nonionic surfactants are the hydrophobic nonionic surfactants having an HLB (hydrophilic-lipophilic balance) below 16 and more preferably below 15. Those hydrophobic nonionic surfactants have been found to provide good grease cutting properties.

Preferred nonionic surfactants for use herein are nonionic surfactants according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0 to 20 and n is from 0 to 15 and m is from 0 to 20, preferably n+m is from 1 to 15 and, n and m are from 0.5 to 15, more preferably n+m is from 1 to 10 and, n and m are from 0 to 10. The preferred R chains for use herein are the $C_8$ to $C_{22}$ alkyl chains. Accordingly, suitable hydrophobic nonionic surfactants for use herein are Dobanol R 91–2.5 (HLB=8.1; R is a mixture of $C_9$ and $C_{11}$ alkyl chains, n is 2.5 and m is 0), or Lutensol R TO3 (HLB=8; R is a C13 alkyl chains, n is 3 and m is 0), or Lutensol R AO3 (HLB=8; R is a mixture of $C_{13}$ and $C_{15}$ alkyl chains, n is 3 and m is 0), or Tergitol R 25L3 (HLB=7.7; R is in the range of $C_{12}$ to $C_{15}$ alkyl chain length, n is 3 and m is 0), or Dobanol R 23-3 (HLB=8.1; R is a mixture of $C_{12}$ and $C_{13}$ alkyl chains, n is 3 and m is 0), or Dobanol R 23-2 (HLB=6.2; R is a mixture of $C_{12}$ and $C_{13}$ alkyl chains, n is 2 and m is 0), or Dobanol R 45-7 (HLB=11.6; R is a mixture of $C_{14}$ and $C_{15}$ alkyl chains, n is 7 and m is 0) Dobanol R 23-6.5 (HLB=11.9; R is a mixture of $C_{12}$ and $C_{13}$ alkyl chains, n is 6.5 and m is 0), or Dobanol R 25-7 (HLB=12; R is a mixture of $C_{12}$ and $C_{15}$ alkyl chains, n is 7 and m is 0), or Dobanol R 91-5 (HLB=11.6; R is a mixture of $C_9$ and $C_{11}$ alkyl chains, n is 5 and m is 0), or Dobanol R 91-6 (HLB=12.5; R is a mixture of $C_9$ and $C_{11}$ alkyl chains, n is 6 and m is 0), or Dobanol R 91-8 (HLB=13.7; R is a mixture of $C_9$ and $C_{11}$ alkyl chains, n is 8 and m is 0), Dobanol R 91-10 (HLB=14.2; R is a mixture of $C_9$ to $C_{11}$ alkyl chains, n is 10 and m is 0), or mixtures thereof. Preferred herein are Dobanol R 91-2.5, or Lutensol R TO3, or Lutensol R AO3, or Tergitol R 25L3, or Dobanol R 23-3, or Dobanol R 23-2, or Dobanol R 23-10, or mixtures thereof. DobanolR surfactants are commercially available from SHELL. LutensolR surfactants are commercially available from BASF and the Tergitol R surfactants are commercially available from UNION CARBIDE.

Suitable anionic surfactants to be used herein include water soluble salts or acids of the formula $ROSO_3M$ wherein R is preferably a $C_6$–$C_{24}$ hydrocarbyl, preferably an alkyl or hydroxyalkyl having a $C_8$–$C_{20}$ alkyl component, more preferably a $C_8$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethylammonium and dimethyl piperdinium cations and quaternary ammonium cations derived from alkylamines such as ethylamine, diethylamine, triethylamine, and mixtures thereof, and the like).

Other suitable anionic surfactants to be used herein include alkyl-diphenyl-ether-sulphonates and alkylcarboxylates. Other anionic surfactants can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_{2CH2}O)_kCH_2COO—M+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred anionic surfactants for use herein are the alkyl benzene sulfonates, alkyl sulfates, alkyl alkoxylated sulfates, paraffin sulfonates and mixtures thereof.

The internal disinfecting polar phase according to the present invention has a pH of from 1 to 12, preferably from 1.5 to 10, and more preferably from 2 to 9. The pH can be adjusted by using alkalinizing agents or acidifying agents. Examples of alkalinizing agents are alkali metal hydroxides, such as potassium and/or sodium hydroxide, or alkali metal oxides such as sodium and/or potassium oxide. Examples of acidifying agents are organic or inorganic acids such as citric or sulfuric acid.

Solvents may be present in the liquid composition according to the present invention. These solvents will, advantageously, give an enhanced cleaning to the disinfecting wipes of the present Invention. Suitable solvents for incorporation herein include propylene glycol derivatives such as n-butoxypropanol or n-butoxypropoxypropanol, water-soluble CARBITOL, solvents or water-soluble CELLOSOLVE, solvents. Water-soluble CARBITOL, solvents are compounds of the 2-(2-alkoxyethoxy)ethanol class wherein the alkoxy group is derived from ethyl, propyl or butyl. A preferred water-soluble carbitol is 2-(2-butoxyethoxy)ethanol also known as butyl carbitol. Water-soluble CELLOSOLVE, solvents are compounds of the 2-alkoxyethoxyethanol class, with 2-butoxyethoxyethanol being preferred. Other suitable solvents are benzyl alcohol, methanol, ethanol, isopropyl alcohol and diols such as 2-ethyl-1,3-hexanediol and 2,2,4-trimethyl-1,3-pentanediol and mixture thereof. Preferred solvents for use herein are n-butoxypropoxypropanol, butyl carbitol, and mixtures thereof. A most preferred solvent for use herein is butyl carbitol.

The liquid composition may further comprise other optional ingredients including radical scavengers, chelating agents, thickeners, builders, buffers, tabilizers, bleach activators, soil suspenders, dye transfer agents, brighteners, anti dusting agents, enzymes, dispersant, dye transfer inhibitors, pigments, perfumes, and dyes and the like.

Suitable radical scavengers for use herein include the well-known substituted mono and di hydroxy benzenes and derivatives thereof, alkyl- and aryl carboxylates and mixtures thereof. Preferred radical scavengers for use herein include di-tert-butyl hydroxy toluene (BHT), p-hydroxytoluene, hydroquinone (HQ), di-tert-butyl hydroquinone (DTBHQ), mono-tert-butyl hydroquinone (MTBHQ), tert-butyl-hydroxy anysole, p-hydroxy-anysol, benzoic acid, 2,5-dihydroxy benzoic acid, 2,5-dihydroxyterephtalic acid, toluic acid, catechol, t-butyl catechol, 4-allyl-catechol, 4-acetyl catechol, 2-methoxy-phenol, 2-ethoxy-phenol, 2-methoxy-4-(2-propenyl)phenol, 3,4-dihydroxy benzaldehyde, 2,3-dihydroxy benzaldehyde, benzylamine, 1,1,3-tris(2-methyl-4-hydroxy-5-t-butylphenyl) butane, tert-butyl-hydroxy-anyline, p-hydroxy anyline as well as n-propyl-gallate. Highly preferred for use herein is di-tert-butyl hydroxy toluene, which is for example commercially available from SHELL under the trade name IONOL CP".

Typically, the radical scavenger, or a mixture thereof, is present in the liquid composition up to a level of 5% by weight, preferably from 0.001% to 3% by weight, and more preferably from 0.001% to 1.5%.

Suitable chelating agents to be used herein may be any chelating agent known to those skilled in the art such as the ones selected from the group consisting of phosphonate chelating agents, amino carboxylate chelating agents or other carboxylate chelating agents, or polyfunctionally-substituted aromatic chelating agents and mixtures thereof.

Such phosphonate chelating agents may include etidronic acid (1-hydroxyethylidene-bisphosphonic acid or HEDP) as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates. Such phosphonate chelating agents are commercially available from Monsanto under the trade name DEQUEST.

Polyfunctionally-substituted aromatic chelating agents may also be useful herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in US Pat. No. 4,704,233, Nov. 3, 1987 to Hartman and Perkins. Ethylenediamine N,N'-disuccinic acid is, for instance, commercially available under the tradename ssEDDS, from Palmer Research Laboratories.

Suitable amino carboxylate chelating agents useful herein include ethylene diamine tetra acetate, diethylene triamine pentaacetate, diethylene triamine pentaacetate (DTPA), N-hydroxyethylethylenediamine triacetate, nitrilotri-acetate, ethylenediamine tetraproprionate, triethylenetetraaminehexa-acetate, ethanoldiglycine, propylene diamine tetracetic acid (PDTA) and methyl glycine di-acetic acid (MGDA), both in their acid form, or in their alkali metal, ammonium, and substituted ammonium salt forms. Particularly suitable to be used herein are diethylene triamine penta acetic acid (DTPA), propylene diamine tetracetic acid (PDTA) which is, for instance, commercially available from BASF under the trade name Trilon FS, and methyl glycine di-acetic acid (MGDA).

Further carboxylate chelating agents to be used herein includes malonic acid, salicylic acid, glycine, aspartic acid, glutamic acid, dipicolinic acid and derivatives thereof, or mixtures thereof.

Typically, the chelating agent, or a mixture thereof, is present in the liquid composition at a level of from 0.001% to 5% by weight, preferably from 0.001% to 3% by weight and more preferably from 0.001% to 1.5%.

The disinfecting wipes according to the present invention are suitable for disinfecting various surfaces including animate surfaces (e.g. human skin) as well as inanimate surfaces including any hard-surfaces.

Other water-soluble or dispersible materials that can be present in the liquid composition include thickeners and viscosity modifiers. Suitable thickeners and viscosity modifiers include polyacrylic and hydrophobically modified polyacrylic resins such as Carbopol and Pemulen, starches such as corn starch, potato starch, tapioca, gums such as guar gum, gum arabic, cellulose ethers such as hydroxypropyl cellulose, hydroxyethyl cellulose, carboxymethyl cellulose, and the like. These thickeners and viscosity modifiers will typically be included in a concentration in the range of from about 0.05 to about 0.5% of the liquid composition.

Again, where water is a major constituent of the liquid composition, water-soluble or dispersible materials that can be present in the internal phase include polycationic polymers to provide steric stabilization at the polar phase-lipid phase interface and nonionic polymers that also stabilize the emulsion. Suitable polycationic polymers include Reten 201, Kymene® 557H and Acco 711. Suitable nonionic polymers include polyethylene glycols (PEG) such as Carbowax and poly(propylene glycol) butyl ether. These polycationic and nonionic polymers will typically be included in a concentration in the range of from about 0.05 to about 1.0% of the liquid composition.

According to the present invention, for wet wipe application designed specifically for use on the human skin such as baby wipes, the composition may be aqueous, alcohol based or an emulsion, either a water-in-oil or an oil-in-water or a multiple emulsion, preferably the emulsion is a oil-in-water emulsion. Typically, the composition will comprise from 2% to 50% by weight of said composition of actives and from 50% to 98% water, preferably de-ionised or distilled. Of the active component, preferably 2% to 20% are present in the oil phase and the remainder are present in the aqueous phase.

According to the present invention the wet wipes are provided with an emulsion composition comprising a oil phase in the range of 1% to 20%, preferably 2% to 10%, by weight of the composition. Advantageously, the oil based phase is derived from natural resources such as from vegetable or animal oils or may be synthetic or any mixtures thereof. Suitable vegetable and animal oils for use herein include waxes such as beeswax, lanolin, candelilla, and oils such as glycerine esters and glycerine ethers, fatty acid alcohols, fatty acid esters and fatty acid ethers such as caprylic and capric triglycerides and octylpalmitate. Suitable mineral oils include petroleum based oils such as paraffin and petroleum jelly. Synthetic oils for use herein include ethylenic polymers for example polyethylene wax or silicone based oils. Suitable silicon oils include polydimethylsiloxanes, volatile cyclomethicones, dimethiconols, siloxysilicates and amino- and phenyl derivatives of siloxanes and mixtures thereof. Examples include dimethicone (Dow Coming 200 Fluids), cyclomethicone and dimethiconol (Dow Corning 1401 Fluid), cetyl dimethicone (Dow Coming 2502 Fluid), dimethicone and trimethylsiloxysilicate (Dow Corning 593 Fluid), cyclomethicone (Dow Coming 244, 245, 344 or 345 Fluid), phenyl trimethicone (Dow Coming 556 Fluid), or combinations thereof.

The oil-in-water emulsions typically require emulsifying agents. The emulsifying agents which may be used in the present invention are preferably capable of primary emulsification of oil-in-water emulsions. The emulsifying agent is present in the range of 0.02% to 5.0%, preferably 0.02% to 3.0%, by weight of the composition.

In a preferred embodiment the emulsifying agent is a polymeric type of emulsifying agent such as a copolymer of C10–C30 alkyl acrylates and one or more monomers of acrylic acid, methylacrylic acid or one of their simple esters cross linked with an allyl ether of sucrose or an allyl ether of pentaerythritol. The emulsifying agents which are thus useful in the present invention include Ceteareth-12, Ceteareth-20 or Pemulen TR1 and TR2 which are available from B.F. Goodrich company of the USA. However, other known emulsifying agents such as ethoxylated fatty alcohols, glycerine esters of fatty acids, soaps, sugar derived agents are also suitable for use herein. Other useful emulsifying agents include those disclosed in detail in EP-A-328 355.

According to the present invention the composition may comprise a stability agent or preservative. Stability agents suitable for use herein include phenoxyethanol preferably present in the range of from 0.1 to 1.0%, sodium benzoate, potassium sorbate, methylparaben, propylparaben, ethylparaben, butylparaben, sodium benzoate, potassium sorbate, benzalkonium chloride, and disodium salt ethylenediamine tetraacetic acid (hereinafter referred to as EDTA) or other EDTA salts (sequestrenes). Sequestrene is a series of complexing agents and metal complexes general of ethylenediaminetetraacetic acid and salts. The total quantity of stability agents should be in the range of 0.1% to 4.0% by weight of the composition.

The composition of the present invention may further comprise from 0.02% to 5.0% by weight of said composition of an emollient or moisturiser. Preferably the emollient is water soluble and includes polyhydric alcohols, such as propylene glycol, glycerin, and also water soluble lanolin derivatives.

In preparing wet wipe products according to the present invention, the composition is applied to at least one surface of the substrate material. The composition can be applied at any time during the manufacture of the wet wipe. Preferably the composition can be applied to the substrate after the substrate has been dried. Any variety of application methods that evenly distribute lubricious materials having a molten or liquid consistency can be used. Suitable methods include spraying, printing, (e.g. flexographic printing), coating (e.g. gravure coating or flood coating) extrusion whereby the composition is forced through tubes in contact with the substrate whilst the substrate passes across the tube or combinations of these application techniques. For example spraying the composition on a rotating surface such as calender roll that then transfers the composition to the surface of the substrate. The composition can be applied either to one surface of the substrate or both surfaces, preferably both surfaces. The preferred application method is extrusion coating.

The composition can also be applied uniformly or non uniformly to the surfaces of the substrate. By non uniform it is meant that for example the amount, pattern of distribution of the composition can vary over the surface of the substrate. For example some of the surface of the substrate can have greater or lesser amounts of composition, including portions of the surface that do not have any composition on it. Preferably however the composition is uniformly applied to the surfaces of the wipes. The composition is typically applied in an amount of from about 0.5 g to 10 g per gram of substrate, preferably from 1.0 g to 5 g per gram of substrate, most preferably from 2 g to 4 g per gram of dry substrate.

Preferably, the composition can be applied to the substrate at any point after it has been dried. For example the composition can be applied to the substrate prior to calendering or after calendering and prior to being wound up onto a parent roll. Typically, the application will be carried out on a substrate unwound from a roll having a width equal to a substantial number of wipes it is intended to produce. The substrate with the composition applied thereto is then subsequently perforated utilizing standard techniques such as in order to produce the desired perforation line.

EXAMPLE I

A) Carrier Preparation

The carrier is a air laid nonwoven substrate comprising 70% pulp, 15% PET and 15% latex. The substrate has a basis weight of 73 g/m$^2$.

B) Liquid composition Preparation

A liquid composition is prepared from the ingredients shown in Table I.

TABLE I

| Ingredients: | Percentage |
|---|---|
| Distilled Water | 87 |
| Salicylic acid | 0.03 |
| Hydrogen Peroxide | 1.0 |
| Ethanol | 9.4 |
| C-12 Amine Oxide | 0.4 |
| Geraniol | 0.04 |
| Thymol | 0.025 |
| Citric acid | 0.07 |
| Glycol butyl ether | 1.4 |

To formulate the composition all the components are mixed together and then heated to 140° F. (45.8° C.).

C) Applying the Liquid Composition to the Carrier

The liquid composition prepared in step B is applied to the carrier by spraying. 3.25 g of lotion per gram of substrate material is applied to the carrier.

The coated carrier is then perforated, folded and stacked. The stack is then sealed to yield finished product wipe.

| Sample | REF | REF | 9 | 4 | 1 | 3 |
|---|---|---|---|---|---|---|
| Bonded area length (mm) | 0.8 | 1.0 | 0.8 | 0.8 | 0.8 | 0.8 |
| Primary slit length (mm) | 4 | 3 | 4 | 6.4 | 3.9 | 6.5 |
| Secondary slit length (mm) | — | — | 1.3 | 1.5 | 1.4 | 1.3 |
| No. bonded areas | 1 | 1 | 5 | 5 | 2 | 4 |
| No. primary slits | 1 | 1 | 1 | 1 | 1 | 1 |
| No. secondary slits | — | — | 4 | 4 | 1 | 3 |
| Ratio of total slit length | 5 | 3 | 9.2:4 | 3.1 | 3.3 | 3.25 |
| Tensile strength (N/inch) | 1.8 | 2.5 | 2.9 | 2.3 | 1.6 | 1.65 |

-continued

| Sample | REF | REF | 9 | 4 | 1 | 3 |
|---|---|---|---|---|---|---|
| No. of patterns | 1 | 1 | 1 | 1 | 1 | 1 |
| No. of repeat patterns per perforation line | 35 | 42 | 13 | 10 | 25 | 12 |

What is claimed is:

1. A sheet of material, said sheet comprising at least one a traverse perforation line, said perforation line having at least one first repeating pattern, characterized in that each of said repeating patterns has at least one primary perforation slit, at least one secondary perforation slit and at least 2 bonded areas, wherein the length ratio of said primary perforation slit to said secondary perforation slit is from 100:1 to 1.5:1 and wherein the ratio of the total length of said bonded areas to the total length of said primary and secondary perforation slits along said perforation line is from 1:1 to 1:6.

2. A sheet of material according to claim 1, wherein said length ratio of said primary perforation slit to said secondary perforation slit as from 50:1 to 2:1.

3. A sheet of material according to claim 1, wherein said ratio of the total bonded area to the total length of the perforation slits along said perforation line is from 1:1.5 to 1:4.

4. A sheet of material according to claim 1, wherein the length of said primary perforation slit is from 3 mm to 10 mm, the length of said secondary perforation slit is from 0.5 mm to 2.5 mm, and the length of said bonded area is from 0.5 mm to 10 mm.

5. A sheet of material according to claim 4, wherein the length of said primary perforation slit is from 3 mm to 8 mm, the length of said secondary perforation slit is from 1 mm to 2 mm and the length of said bonded area is from 0.5 mm to 3 mm.

6. A sheet of material according to claim 1, wherein said perforation line has a tensile strength of from 0.7 N/inch to 5 N/inch.

7. A sheet of material according to claim 6, wherein said perforation line has a tensile strength of from 1 N/inch to 4.5 N/inch.

8. A sheet of material according to claim 1, wherein said repeating pattern comprises at least 1 of said primary perforation slits, at least 4 of said secondary perforation slits and at least 5 of said bonded areas.

9. A sheet of material according to claim 1, wherein said material is an airlaid nonwoven comprising hydrophilic and hydrophobic fibres.

10. A sheet of material according to claim 1, wherein said sheet comprises from 0.5 g to 10 g per gram of material of a liquid composition.

* * * * *